United States Patent [19]

Lautenschläger

[11] 4,091,498

[45] May 30, 1978

[54] HINGE FOR FURNITURE

[75] Inventor: Reinhard Lautenschläger, Reinheim, Odenwald, Germany

[73] Assignee: Karl Lautenschläger KG Möbelbeschlagfabrik, Reinheim, Odenwald, Germany

[21] Appl. No.: 780,783

[22] Filed: Mar. 24, 1977

[30] Foreign Application Priority Data

Apr. 17, 1976 Germany ..... 2617071

[51] Int. Cl.[2] ..... E05D 5/00

[52] U.S. Cl. ..... 16/128 R; 16/137; 16/163

[58] Field of Search ..... 16/128 R, 162–166, 16/137, 159

[56] References Cited

U.S. PATENT DOCUMENTS

| | | | |
|---|---|---|---|
| 3,562,853 | 2/1971 | Heinze | 16/163 |

FOREIGN PATENT DOCUMENTS

| | | | |
|---|---|---|---|
| 653,160 | 1/1965 | Belgium | 16/163 |
| 1,459,057 | 11/1968 | Germany | 16/163 |
| 2,210,614 | 9/1973 | Germany | 16/163 |

*Primary Examiner*—James Kee Chi

[57] ABSTRACT

A cabinet hinge whose door part is joined pivotingly by a linkage to an elongated support arm which is fastened in a longitudinally adjustable manner to a mounting plate disposed on the door-supporting wall of the cabinet, wherein the support arm has, adjacent to its door-side front end, a stop projecting at approximately right angles to the supporting wall and having a bearing surface which faces rearwardly and can be brought to bear against a face end surface of the supporting wall, the disposition of the stop being such that its bearing surface is located substantially in the plane of the inside of a door fastened to the door-part of the hinge when the hinge is in the closed position.

2 Claims, 2 Drawing Figures

FIG. 1
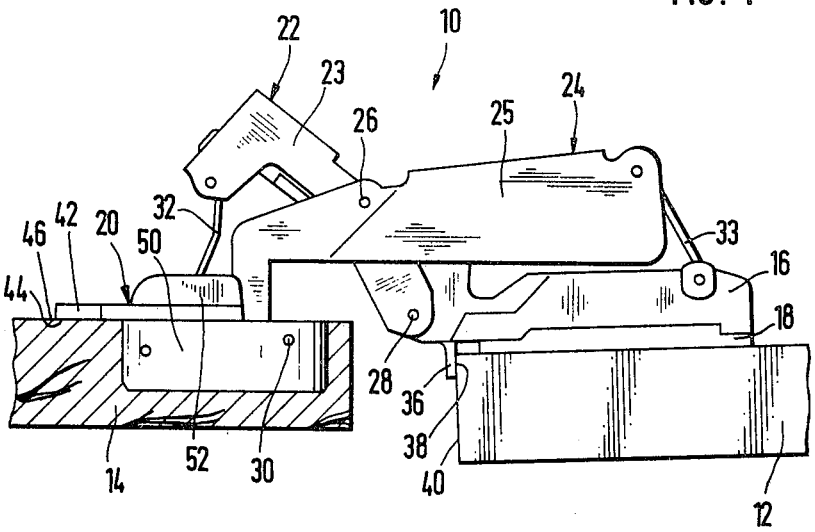
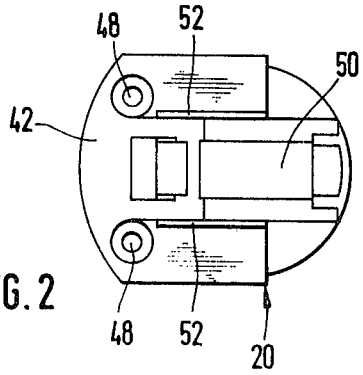
FIG. 2

HINGE FOR FURNITURE

BACKGROUND

The invention concerns a cabinet hinge whose door part is joined pivotingly by a linkage to an elongated support arm which is fastened in a longitudinally adjustable manner to a mounting plate disposed on the door-supporting wall of the cabinet.

Modern furniture is frequently provided with overlapping-edge doors which, when in the closed state, overlap the face edges of the top, side and bottom walls of the cabinet. The doors are supposed to close as tightly as possible against the walls of the cabinet so as to prevent the entry of dust. Furthermore, it is also esthetically unsatisfactory for a plainly visible gap to exist between the door and the adjoining cabinet wall. In the case of cabinets having a plurality of doors, it is especially undesirable for the gaps to vary in size. The hinges joining the doors to the door-supporting walls of the cabinets, which today are cantilever hinges, as a rule, are therefore able to be adjusted not only for the alignment of the door but also for their position which determines the size of the gap.

For this purpose, the door-supporting-wall parts of the hinges, constructed in the form of supporting arms, are, as a rule, disposed on mounting plates so as to be longitudinally displaceable in the horizontal direction, and so as to be fixable on such mounting plates in a choice of positions, the mounting plates being fastened on the door-supporting-wall of the cabinet in a fixed manner. The fastening screws which secure the support arm in the selected longitudinal position are thus located in the interior of the cabinet and consequently are not accessible when the cabinet doors are closed, so that the adjustment of the door gap must be performed while the door is open. When the door is open, the size of the gap cannot, however, be observed, so that the adjusting procedure is virtually a trial-and-error procedure involving repeated opening of the door, adjustment of the support arm, closing of the door and checking the gap, etc., until the correct door alignment is achieved such that the back of the door will make a virtually all-around contact with the face end of the door-supporting wall of the cabinet.

THE INVENTION

The invention is addressed to the problem of improving the known hinges such that the setting of the correct contact between the back of the door and the end face of the supporting wall can be performed in a single procedure during the installation of the door while in the open position, although the possibility must still be provided for compensating for changes in door alignment, which can never be fully excluded in cabinets of wooden material on account of the warping tendency of wood.

Setting out from a hinge of the initially described kind, this problem is solved in accordance with the invention in that the support arm has, adjacent to its door-side front end, a stop projecting at approximately right angles to the supporting wall and having a bearing surface which faces rearwardly and can be brought to bear against a face end surface of the supporting wall, the disposition of the stop being such that its bearing surface is located substantially in the plane of the inside of a door fastened to the door part of the hinge when the hinge is in the closed position. Since the bearing surface of the stop is in alignment with the inside of the closed door and retains this position even when the door is opened, since it is disposed on the supporting-wall part of the hinge, a door equipped with the hinge of the invention can be adjusted without difficulty while it is open for minimum gap between the inside of the door and the face end of the door-supporting wall, by first pushing the support arms, which are at first only loosely set on the mounting plates on the supporting wall, until they engage the stop engaging surface on the supporting wall end face, and then tightening the screws to fasten the support arm. When the door is closed, its inside will be in direct, positive engagement with the end face of the supporting wall. If in the course of time the gap width increases for reasons attributable to shrinkage of the wood of the supporting wall due to excessively dry environment (central-heated home), a readjustment can be easily accomplished by loosening the screws holding the support arm on the mounting plate, doing so while the door is open, pushing the support arm back again until the stop contacts the face edge of the supporting wall which serves as the reference surface, and finally re-tightening the screws.

If the door part of the hinge is in the form of a cup which can be fastened in a mortise in the door, it is desirable to make the stop of such a size that, when the hinge is in the closed position, the stop will be located within the cup. This eliminates the need for cutting a mortise in the inside face of the door which would otherwise be required for the stop.

In an advantageous further development of the invention, the cup can be provided directly adjacent the mouth of its recess for the accommodation of the door-end articulations of the linkage, with two projecting strips extending at right angles to the imaginary pivoting axis and parallel to the inside of the door, which are preferably formed integrally with the cup. These strips form a certain protection against the accidental pinching of loose objects contained in the cabinet or the pinching of the finger of a child opening or closing the cabinet door between one of the hinge links or arms and the edge of the cup.

The invention will be further explained in the description that follows of an embodiment thereof, in conjunction with the drawing, wherein:

FIG. 1 is a side elevational view of a hinge of the invention serving for the mounting of a door on the supporting wall of a cabinet, such hinge in the illustrated embodiment being a knuckle-joint hinge which is represented in the open state at 90° from the closed position of the door, and FIG. 2 is a top plan view of the door part of the hinge represented in FIG. 1, said door part being in the form of a cup for setting in a mortise in the door.

The hinge shown in FIG. 1 and generally designated by the numeral 10 is represented in the form of a cantilever hinge, i.e., a hinge which enables the door to pivot by more than 90°, preferably 180°. It is pointed out, however, that the hinge configuration in accordance with the invention as described below is applicable advantageously to other hinges, such as, for example, the common and widely used knucklejoint hinges. The hinge 10 in accordance with the invention serves to fasten a door 14 to a wall 12 of a cabinet. The wall part 16 of the hinge is fastened in a conventional manner to the wall 12 by means of a mounting plate. The door part 20 has the likewise popular form of a cup for recessing in a mortise and can be made of plastic by the injection molding process or of metal by the die casting process.

The knuckle joint is formed by two arms 22 and 24 having pairs of parallel flanges 23 and 25 which are pivoted on one another in their middle portion on a pivot pin 26, the inner sides of the flanges 25 of arm 24 overlapping the outer sides of flanges 23 of arm 22 with a slight clearance. The arm 22 is pivoted on the wall part 16 of the hinge on a pivot pin 28 and arm 24 is pivoted on the door part of the hinge about pivot pin 30.

To the other end of arm 22 there is articulated a link 32 which is articulated at its other end to the door part 20 of the hinge, and which guides this end of arm 22 on an arcuate path. The second end of arm 24 is likewise coupled by a link 33 to the support arm 16 of the hinge. Up to this point the cantilever hinge described corresponds to the known hinges of this type of construction.

In further development in accordance with the invention, however, a stop 36 whose contact surface 38 faces toward the rearward or inner end of the support arm 16, is integrally formed on the front or outer end of the latter, extending therefrom at right angles towards the door-bearing wall 12. The stop 36 projects from the support arm 16 by an amount that is greater than the thickness of the mounting plate 18 between the wall 12 and the support arm 16. The contact surface 38 of the stop therefore projects to a point in front of the end face 40 of wall 12 and can be brought into contact therewith. Since the support arm 16 is constructed in a conventional manner so as to be longitudinally displaceable to a certain degree and to be locked selectively at the desired longitudinal position on the mounting plate 18, the position of the contact surface 38 of the stop 36 determines the position to which the support arm can be pushed on the mounting plate towards the interior of the cabinet, i.e., the position of the end face 40 of the wall constitutes the plane of reference for the adjustment of the support arm of the hinge. In accordance with the invention, the stop is disposed on the support arm in such a position that its contact surface 38, when the hinge 10 is in the closed position, will be located in the same plane as the underside of a fastening flange 42 of the cup 20. By means of this fastening flange 42, the cup is fixed in its position in its mating mortise in door 14, the underside 44 of the fastening flange 42 resting on the inside 46 of the door 14. The cup 20 is fastened in door 14 in this case, for example, by means of screws which are not shown, and which are driven through the countersunk screw holes 48, which can be seen in fastening flange 42 in FIG. 2, into the door 14. Therefore, since the contact surface 38 of stop 36 and the underside 44 of the fastening flange 42 are in alignment when the hinge is closed, the inside 46 of door 14 will also be in contact, without any noticeable gap, with the end face 40 of wall 12 if the support arm 16 of the hinge has been affixed to the mounting plate such that the contact surface 38 of stop 36 engages the end face 40 of the wall 12.

A simple means is thus created for the correct mounting of a door 14 provided with hinges 10 in accordance with the invention on the door-supporting wall 12 of a cabinet, when the said wall has been provided with the mounting plates 18. The support arms 16 of the hinges are first mounted loosely, i.e., so as to be still longitudinally displaceable, on the mounting plates 18, and then, with the door open, the hinges are pushed inwardly until the contact surfaces 38 of the stops 36 encounter the end face 40 of the wall 12. It is to be pointed out that this is done simultaneously with all knuckle joint hinges 10 provided on a door, i.e., the hinges do not have to be adjusted individually. The support arms 16 of the hinges are then affixed to the mounting plates 18 by tightening the fastening screws provided for this purpose (not shown). If the door 14 is then closed, it will lie tightly in the required manner, i.e., without gap, against the end face of the supporting wall, and hence also against the end faces of the bottom and top of the cabinet which are in the same plane.

On the fastening flange 42, directly adjacent the elongated mouth of the recess 50 in cup 20 for the accommodation of the door-end of link 32 and of the arm 24, two lateral strips 52 extending at right angles to the imaginary pivot axis of hinge 10 and parallel to the inside 46 of the door are provided in an advantageous further development of the invention, and bring about not only an improvement of the strength of the fastening flange, but also safety against the pinching of loose objects, such as articles of clothing, by the links 32 inside of the cup. They also reduce the danger of the pinching of the fingers of a child opening the door.

It is to be pointed out that the invention is not limited to the specially described embodiment, and that modifications and further developments can be undertaken within the scope of the idea of the invention. In particular it is to be stated, as previously mentioned, that the adjusting aid provided on the support arm in accordance with the invention can also be provided in the case of hinges of other design, such as for example the four pivot hinges which are so widely in use.

I claim:

1. A cabinet hinge for use in a piece of furniture having a door and a door-supporting wall, said hinge having a door part, an elongated support arm, a linkage pivotingly joining said door part to said elongated support arm and having pivots at said door part, a mounting plate for disposition on the door-supporting wall and having means for longitudinally adjustably fastening said support arm to said mounting plate, said door-part being in the form of a cup fastenable in said recess and having a mouth for receiving said pivots, and two projecting strips arranged directly adjacent said mouth and extending at right angles to the imaginary pivot axis of said hinge and parallel to each other.

2. A hinge according to claim 1, wherein said strips are formed integrally on the cup.

* * * * *